United States Patent [19]

Ajioka et al.

[11] 4,042,935

[45] Aug. 16, 1977

[54] WIDEBAND MULTIPLEXING ANTENNA FEED EMPLOYING CAVITY BACKED WING DIPOLES

[75] Inventors: James S. Ajioka; George I. Tsuda, both of Fullerton, Calif.

[73] Assignee: Hughes Aircraft Company, Culver City, Calif.

[21] Appl. No.: 620,896

[22] Filed: Oct. 8, 1975

Related U.S. Application Data

[63] Continuation-in-part of Ser. No. 493,791, Aug. 1, 1974, abandoned.

[51] Int. Cl.[2] ..... H01Q 9/16; H01Q 21/26

[52] U.S. Cl. ..... 343/795; 343/797; 343/816; 343/840

[58] Field of Search ..... 343/727, 779, 789, 795, 343/797, 816, 840

[56] References Cited

U.S. PATENT DOCUMENTS

| | | | |
|---|---|---|---|
| 3,358,288 | 12/1967 | Dubost et al. | 343/895 |
| 3,555,554 | 1/1971 | Kuo | 343/895 |
| 3,665,481 | 5/1972 | Woo | 343/779 |
| 3,713,167 | 1/1973 | David | 343/789 |
| 3,820,117 | 6/1974 | Hall et al. | 343/895 |
| 3,864,687 | 2/1975 | Walters et al. | 343/778 |

*Primary Examiner*—Eli Lieberman

*Attorney, Agent, or Firm*—Don O. Dennison; W. H. MacAllister

[57] ABSTRACT

An antenna feed system having a very wide (multi-octave) bandwidth. The antenna feed comprises a plurality of nested annular cavities each parasitically excited by a pair of orthogonal two-point fed dipoles. The frequency selective properties of the dipoles and the annular cavities in conjunction with the focal distribution of the reflector or lens with which the feed is used results in a multiplexing of sub-bands across the total bandwidth. A modification of the end members of the two-point fed dipoles permits dual-plane and dual polarization monopulse operation of the feed system.

11 Claims, 16 Drawing Figures

WIDEBAND MULTIPLEXING ANTENNA FEED EMPLOYING CAVITY BACKED WING DIPOLES

CROSS REFERENCE TO RELATED APPLICATION

This application is a continuation-in-part of copending application Ser. No. 493,791, filed Aug. 1, 1974, now abandoned.

FIELD OF THE INVENTION

This invention relates to high frequency antenna systems and more specifically to wideband feeds for use in such antenna systems.

DESCRIPTION OF THE PRIOR ART

In the past, a number of feeding techniques for large reflectors or lenses have been employed for the purpose of obtaining wide bandwidths in high frequency dual polarized directive antennas. These include the use of nested horns, nested dipole clusters or dual polarized arrays of log-periodic elements. These antennas are of relatively low efficiency.

The relative low efficiency of the above-mentioned broadband techniques is due to the fact that their near field distributions do not match the focal distribution of the lens or reflector with which they are used. Consider, for example, a plane wave incident on the aperture of the reflector or lens. The aperture provides a large capturing area for the incident power from the plane wave. The reflector or lens converts the plane wave to a converging spherical wave and focusses (concentrates) the power in a small region about the geometrical focal point where it is "picked up" by the feed system. The efficiency of the antenna is determined by the fractional portion of the focussed power that is transferred to the feed. The feed system having an effective feed aperture distribution that matches the focal plane distribution in amplitude, phase and polarization results in the highest possible efficiency. In short, the degree of match between the feed aperture distribution to focal plane distribution determines the antenna efficiency. In the previous broadband feeds, the center portion of the focal plane function (where the intensity is highest) is not well matched to the focal distribution.

For example, the nested horn or nested cavity feed, at any given frequency, has a center region which is blocked out by the next higher frequency band cavity and so on. Hence, the focal plane distribution which is maximum in the center is not matched to the feed aperture distribution. The nested quad-dipole feeds lack a central element and are therefore also unable to match the focal plane distribution in an efficient manner.

Wide-band single-feed radiators such as log periodics or conical spirals have also been utilized for feeding reflectors or lenses. With such radiators, however, external multiplexers are required to separate the wide band of frequencies into the desired sub-bands for transmitting and receiving. In addition, if such radiating structures are used with reflectors or lenses, changes in the effective axial phase center with frequency give rise to undesirable antenna defocusing.

In the copending application of J. S. Ajioka, et al., Ser. No. 244,158, filed Apr. 14, 1972, now U.S. Pat. No. 3,803,617 issued Apr. 9, 1974, there is described an antenna feed which overcomes some of the limitations of the prior art structures noted above. The invention disclosed in that application comprises a single crossed dipole array backed by a cylindrical cavity. Centrally disposed within the cavity and the dipole array is a dual mode waveguide horn operating at two separate frequencies. This antenna is designed for high power operation in three separate non-contiguous sub-bands.

Accordingly, it is an object of the present invention to provide an efficient wideband antenna feed system having a multiplexing capability between a plurality of contiguous sub-bands.

It is another object of the present invention to provide a wideband antenna feed system having an effective phase center which is substantially invariant as a function of frequency.

It is yet another object of the present invention to provide antenna feed system operable over a continuous multi-octave bandwidth with monopulse capabilities over at least a portion of this bandwidth.

SUMMARY OF THE INVENTION

In keeping with the principles of the present invention, a plurality of nested annular cavities are coaxially disposed about a central waveguide horn, cup-dipole or endfire element. Each of the annular cavities is parasitically excited by a pair of orthogonal two-point fed dipoles. Each of the dipoles of the pair comprises two dipole wings and the rim of the inner cavity wall associated with that dipole. Each dipole is fed at two diametrically opposed points on the cavity wall. The dipole currents thus flow in the dipole wings and around the rim of the inner cavity wall. The effect of the dipole currents flowing around the rims of the inner cavity walls is to create effective dipoles which include the central region (the region of highest focal plane energy distribution).

The size of the focal plane distribution (spot size) is inversely proportional to frequency; and the proportionality constant is dependent upon the focal length-to-diameter ratio. By matching the effective feed aperture to the focal spot the efficiency of the antenna can be maximized. Also, the cutoff characteristics of each of the dipole-cavity assemblies can be made quite sharp and this ability coupled with the frequency "sensitivity" of the spot size results in the multiplexing action of the feed system.

Alternative configurations can be devised which increase or broaden the frequency range of the center element and the several dipole-cavity assemblies. For example, ridged waveguide or ridged cavity assemblies can be employed to effectively lower the cutoff frequencies of the guides or cavities. Overlapping frequency ranges of the several dipole-cavity assemblies can be obtained, if desired.

By "splitting" the dipole end members, or wings, and feeding the split wings "differentially" or in an antiphase relationship, the characteristics of the antenna feed is substantially altered. With such a modified feed and with the addition of suitable hybrid networks, it is possible to obtain dual-plane monopulse operation for orthogonal planes of polarization.

BRIEF DESCRIPTION OF THE DRAWINGS

The above-mentioned and other features and objects of the present invention will become more apparent by reference to the following description taken in conjunction with the accompanying drawings, wherein like reference numerals denote like elements and, in which.

DESCRIPTION OF THE PREFERRED EMBODIMENTS

Figure 1:
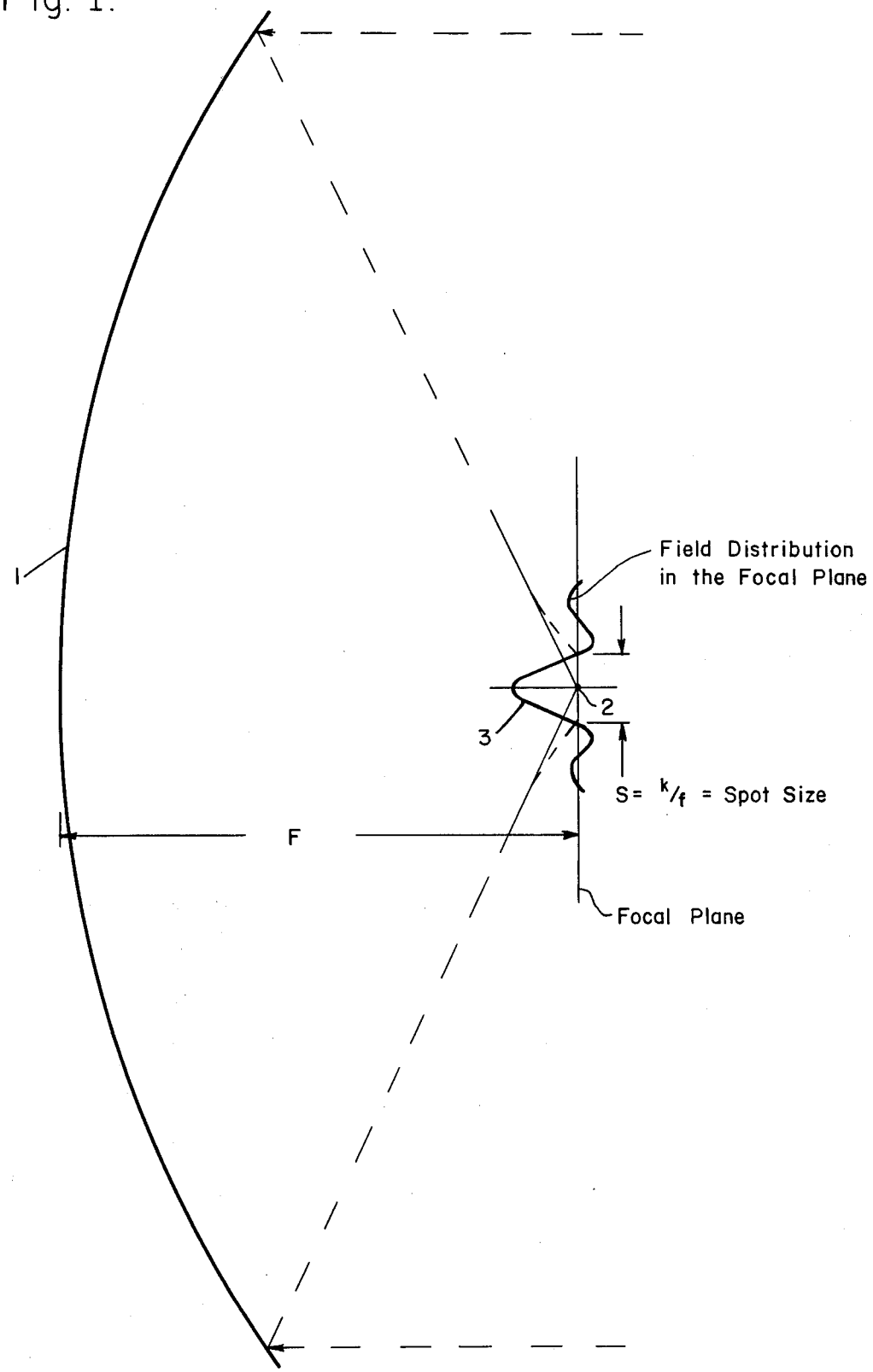
FIG. 1 is a simplified cross-sectional view of a parabolic reflector illustrating the field distribution in the focal plane for plane wave energy incident thereon.

Referring more specifically to the drawings, there is shown in FIG. 1 a simplified cross-sectional view of a parabolic reflector useful in understanding the principles of the present invention. In FIG. 1 a parabolic reflector 1 is illuminated by electromagnetic wave energy from a plane wave arriving from the right. The reflector provides a large capturing area for the incident energy from the plane wave. The reflector converts the plane wave to a converging spherical wave and focusses or concentrates the energy in a small region about the geometrical focal point 2 where it is coupled to the feed (not shown).

The focal plane energy distribution is somewhat as shown by curve 3 superimposed on the focal plane of the reflector of FIG. 1. As is well known, the size of the focal spot is inversely proportional to frequency. The proportionality constant *k*, in turn, depends upon the F/D or focal length-to-diameter ratio. As will be seen, the feed system of the present invention is designed to match this focal plane energy distribution over a wide bandwidth.

Figure 2:
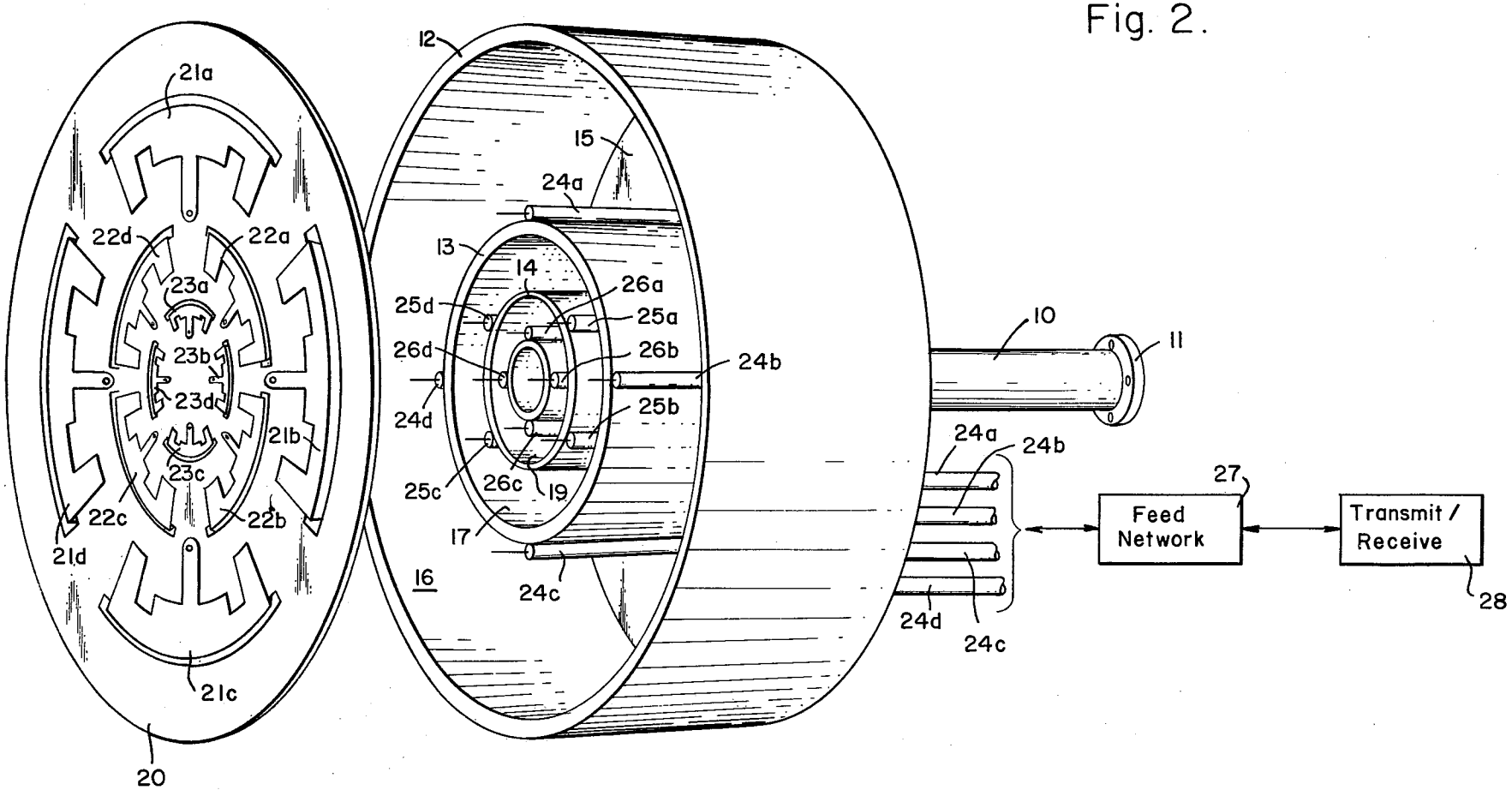
FIG. 2 is a partially exploded pictorial view of a preferred embodiment of the present invention.

In FIG. 2, there is shown a partially exploded pictorial view of an antenna feed in accordance with the principles of the present invention. Centrally located in the feed of FIG. 2 is a section 10 of cylindrical waveguide. One end of waveguide section 10 is provided with a suitable flange 11 for facilitating connection to transmit/receive apparatus not shown. The other end of waveguide section 10 forms a central horn. If desired, waveguide section 10 can be provided with ridges or other obstacles for multimoding or broadbanding as illustrated in connection with FIG. 10.

In the alternative, the central waveguide section 10 can be replaced by other suitable radiating structures. For example, instead of a waveguide horn, section 10 can comprise an inner cavity or cup and a pair of crossed-dipoles disposed therein.

Coaxially disposed around the waveguide horn (or dipole-cavity) are three concentric conductive cylinders 12, 13 and 14. Cylinders 12 and 13 are conductively joined along one of the respective edges to an annular conductive ring 15 to form a first cavity 16. A second cavity 17 is formed in a similar manner by cylinders 13, 14 and a second annular ring. A third cavity 19 between cylinder 14 and waveguide section 10 is similarly formed. The composite structure thus formed comprises three "nested" cavities 16, 17 and 19 and a central horn all coaxially disposed.

A thin disc 20 of low loss dielectric material is disposed over the cavity-feed horn assembly. For the purpose of illustration, disc 20 is shown in an exploded or axially displaced location from the cavity-feed horn assembly. In practice, disc 20 rests against the cavity-feed horn assembly and is conveniently joined thereto, for example, by means of a flange, not shown, on conductive cylinder 12.

Disposed on disc 20 are a plurality of conductive dipole wings 21*a*, 21*b*, 21*c*, 21*d*; 22*a*, 22*b*, 22*c*, 22*d* and 23*a*, 23*b*, 23*c* and 23*d*. These dipole wings, the details of which are more clearly shown in FIGS. 3 and 4, form a portion of the orthogonal dipole arrays of the invention. Each of the dipole wings is conductively joined to the inner conductor of a coaxial transmission line. Coaxial transmission lines 24*a*, 24*b*, 24*c* and 24*d*, which extend through annular ring 15, provide the feed means for dipole wings 21*a*, 21*b*, 21*c* and 21*d*, respectively.

In a similar manner coaxial transmission lines 25*a*, 25*b*, 25*c* and 25*d* provide the feed means for dipole wings 22*a* through 22*d* and lines 26*a* through 26*d* provide the feed means for dipole wings 23*a* through 23*d*. To facilitate assembly, disc 20 and the dipole wings disposed thereon are provided with appropriately aligned holes which accommodate the coaxial line center conductors. When disc 20 is in position, the center conductors can be soldered or otherwise conductively joined to their respective dipole wings. The outer conductors of all the coaxial feed lines are grounded to the respective conductive cylinders which form the inner rims of cavities 16, 17 and 19.

The other ends of coaxial feed lines 24*a* through 24*d* are connected to a feed network 27 which, in turn, is connected to transmit/receive apparatus 28. The other coaxial lines are similarly connected to their respective feed networks, not shown. Each of the feed networks, such as 27, can comprise, for example, a pair of broadband 180° hybrid networks. The so-called "side arms" of one hybrid network are coupled to coaxial lines 24*a* and 24*c* and the "side arms" of the other hydrid network are coupled to coaxial lines 24*b* and 24*d*. In the above-mentioned U.S. Pat. No. 3,803,617, it is shown how such feed networks can be utilized to provide limited "monopulse" operation with such an orthogonal dipole assembly.

Figure 3:
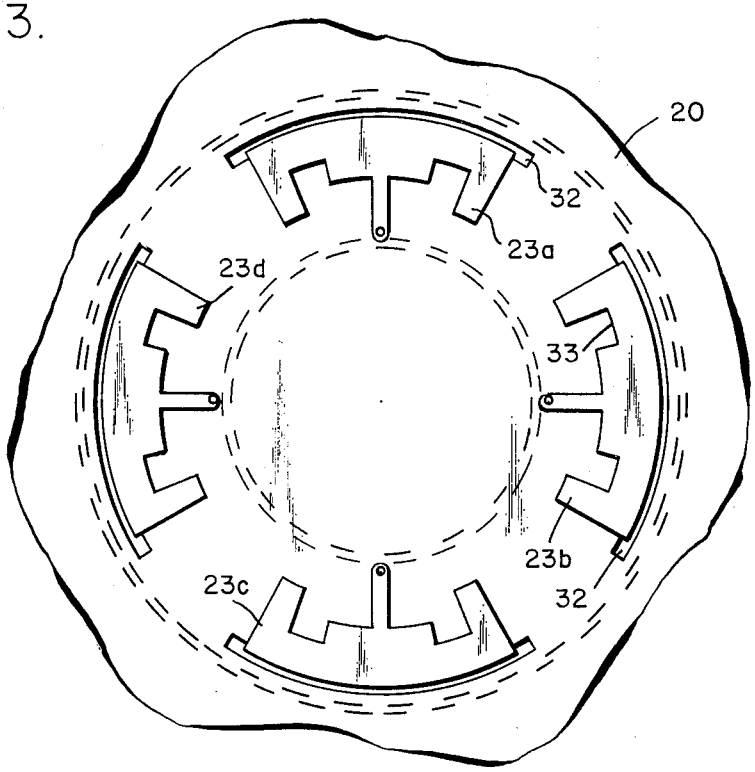
FIG. 3 is a partial plan view of the embodiment of FIG. 2.
Figure 4:
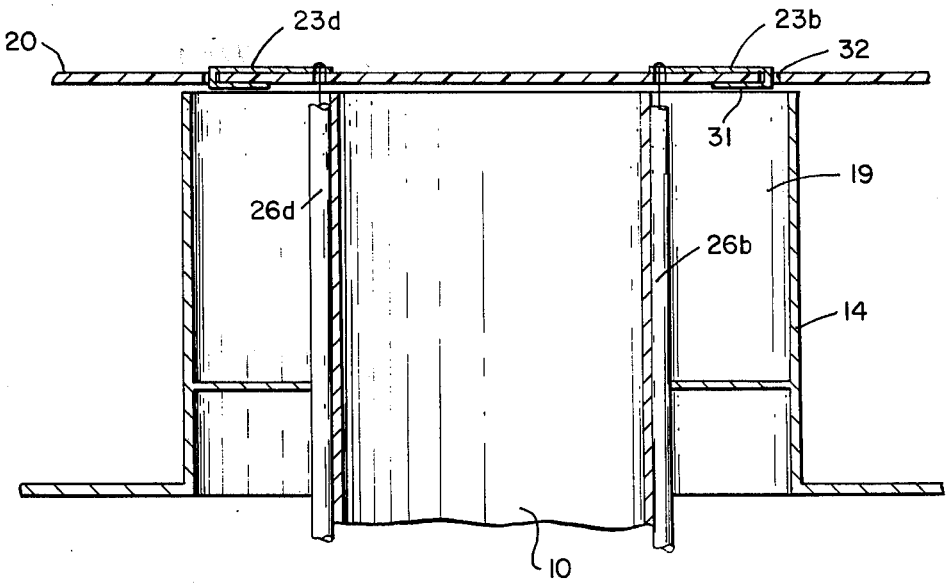
FIG. 4 is a partial cross-sectional view of the embodiment of FIG. 1.

Referring now to FIGS. 3 and 4 taken together, there is shown in partial plan view and cross-section, respectively, the central region of the embodiment of FIG. 1 with special detail of the geometry of dipole wings 23*a* through 23*d*. It is to be emphasized that the particular form of these dipole wings is merely exemplary and that the scope of the present invention should not be deemed as limited thereto.

Taking dipole wing 23b as representative of these elements, it is characterized first by a folded geometry evident in FIG. 3. The dipole wings are advantageously fabricated of a thin, conductive material such as copper, silver or gold and are printed, glued or otherwise bonded to the upper surface of dielectric disc 20. A portion 31 of dipole wing 23b is folded back through a suitably located slot 32 along the underside of disc 20 where it can be likewise bonded. Additionally, each of the dipole wings has formed therein notches 33. These notches serve to create choke sections which are geometrically proportioned to limit the response of the dipole wings for undesired higher frequencies.

Figure 5A:
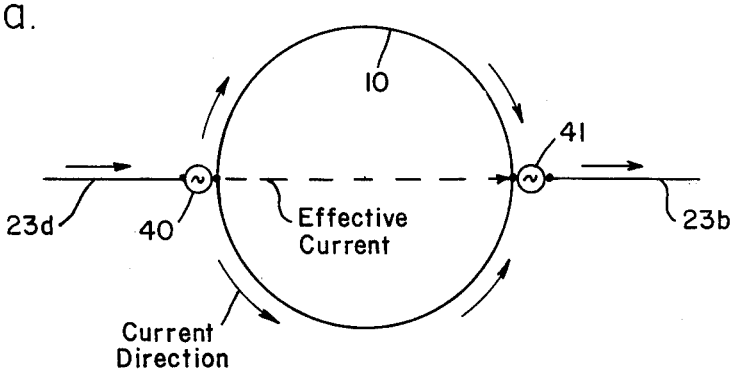
FIGS. 5*a*, 5*b*, 6*a* and 6*b* are schematic illustrations of the current flow and current distribution in the dipole elements of the embodiment of FIG. 2.
Figure 5B:
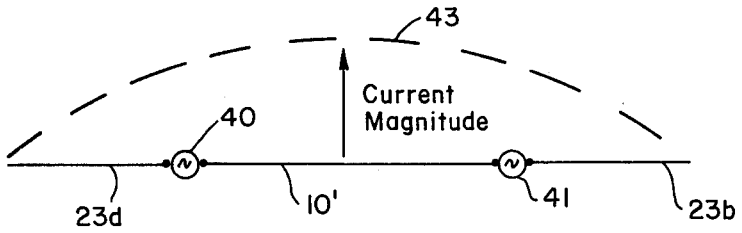

In FIGS. 5a and 5b there is shown in elemental form one of the dipoles forming the orthogonal dipole array 23a, 23b, 23c and 23d. The two-point fed dipole comprising elements 23b, 23d and the rim or perimeter of waveguide section 10 is shown with the coaxial feed lines having been replaced by equivalent signal voltage sources 40 and 41. When voltage sources 40 and 41 drive the dipole segments 23d, 10 and 23b in phase, the instantaneous current in the dipole is as shown by the arrows. The two dipole wings 23d and 23b, together with the conductive ring formed by the rim of waveguide section 10, therefore, resemble a half-wave dipole as seen in FIG. 5b. The current distribution depicted graphically by curve 43 is similar to that of a typical dipole with the exception that it is fed at two points rather than one. The circular current path around the perimeter of waveguide horn 10 has been equated to a straight dipole 10'.

Figure 6A:
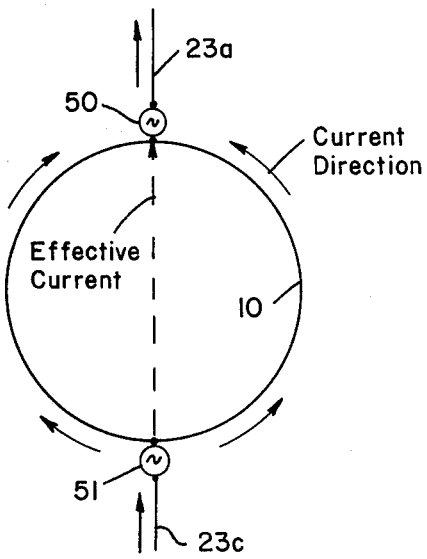
Figure 6B:
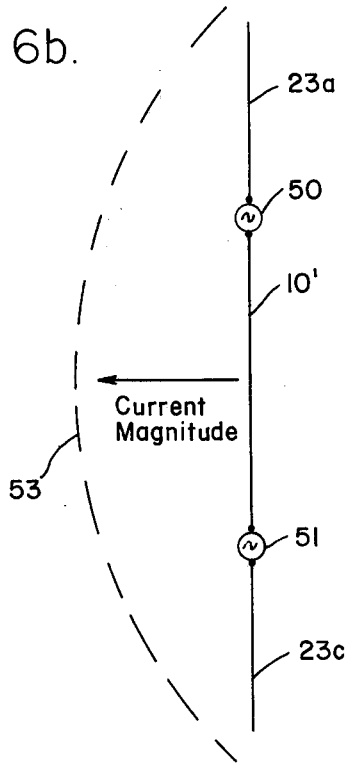

The two-point fed dipole comprising wings 23a, 23c and the rim of waveguide section 10 is illustrated in FIG. 6a. As before, the feed lines have been replaced by equivalent signal voltage sources 50 and 51. The direction of current flow is indicated, as before, by the arrows. In FIG. 6b the current magnitude along the dipole is depicted by curve 53. A superposition of the current distribution in the two orthogonal dipoles of FIGS. 5a and 6a furnishes the composite current distribution.

It is readily seen that depending upon the arrangement of the feed network, linear, eliptical or circular polarization can be achieved. In addition, it is possible to obtain monopulse operation by feeding the two dipole wings out of phase.

Figure 7:
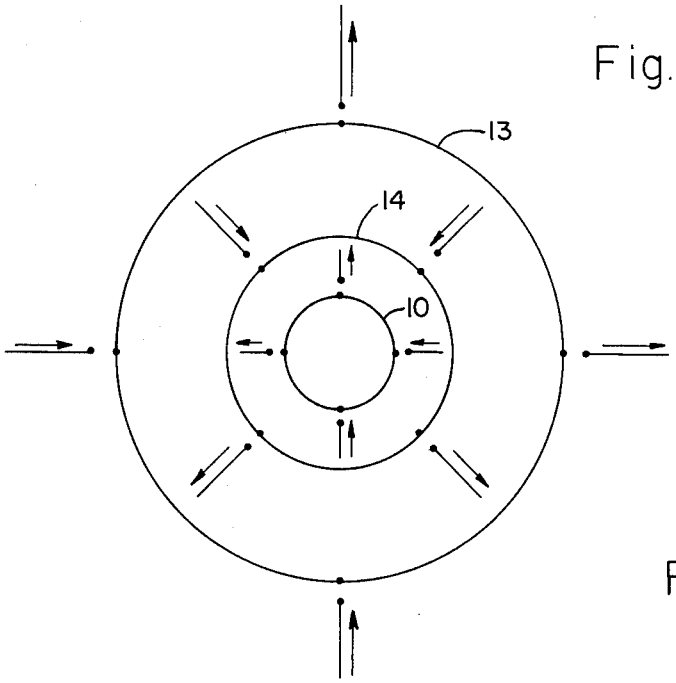
FIG. 7 is a schematic representation of the multiple dipole feed portion of the present invention.

In FIG. 7 there is shown a schematic representation of the three crossed dipole arrays of the embodiment of FIG. 2. If all of the dipoles are fed in phase as shown in the examples of FIGS. 5a, 5b, 6a and 6b, then the instantaneous current in the various dipole wings are in the same direction as shown by the arrows. The effective currents of the center portions of each of the dipoles are also in the same direction for this feed condition.

Figure 8:
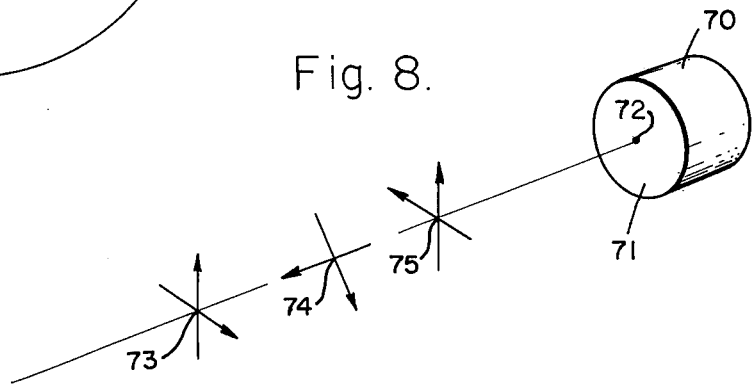
FIG. 8 is a simplified pictorial representation of typical polarization vectors of energy radiated by the feed.

The composite feed assembly of FIG. 2 is shown as a cylinder 70 in the greatly simplified pictorial view of FIG. 8. The face 71 of cylinder 70 corresponds to the plane of the orthogonal dipole clusters of FIG. 2. The effective phase center of the radiated wave energy corresponds to the center point 72 of the cylinder face. The electric vectors of the radiated wave energy for the antenna feed system is illustrated by crossed vectors 73, 74 and 75 for the feed condition of FIG. 7.

Figure 9:
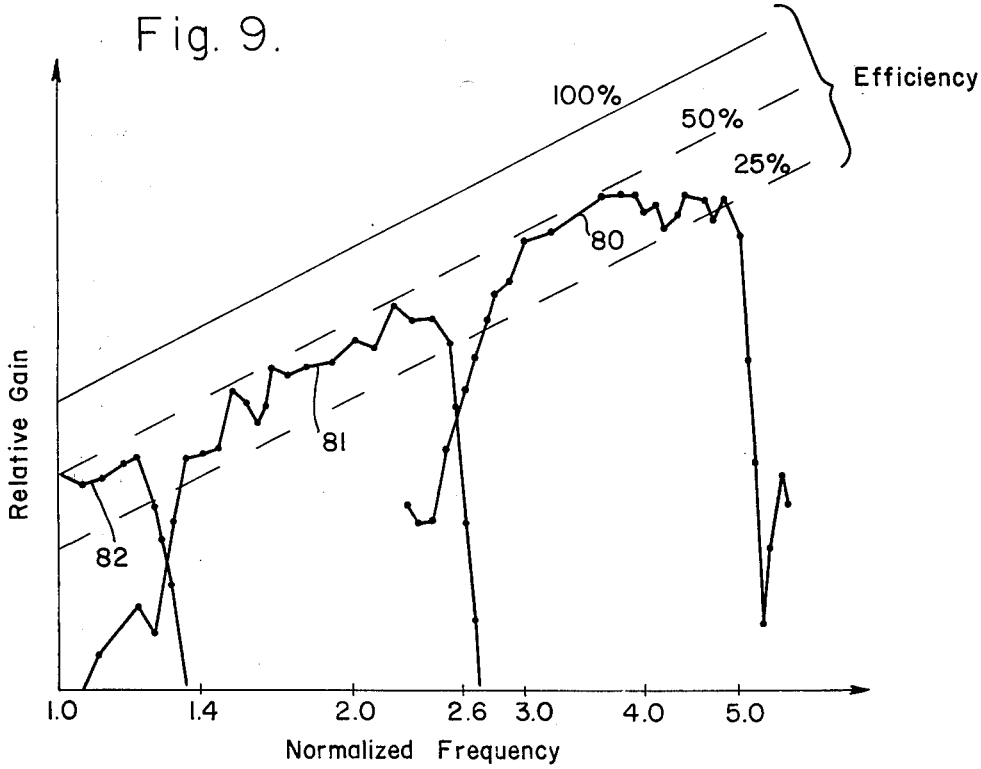
FIG. 9 is a graphical representation of the relative gain vs. frequency characteristics of the feed of the present invention.

In FIG. 9 there is shown in graphical form the relative gain vs. frequency characteristics of the antenna feed system of the present invention. In the graph of FIG. 9 the normalized frequency is plotted on the *x*-axis and the relative gain on the *y*-axis. The antenna characteristics for the highest frequency crossed dipole-cavity assembly is depicted by curve 80. This corresponds to cavity 19 and the dipoles which include wings 26a through 26d. In a like manner curve 81 corresponds to the medium frequency orthogonal dipole-cavity assembly. Curve 82, which, for the sake of simplicity, has been omitted below the unity frequency point corresponds to the lower frequency assembly.

The self-multiplexing feature of the invention is readily seen from FIG. 9. Each portion of the antenna is characterized by a relatively high efficiency over substantially an octave bandwidth with sharp cutoff frequencies. It is apparent that if further subdivision of the frequency bands is desired, conventional narrow band multiplexing techniques can be employed.

Figure 10:
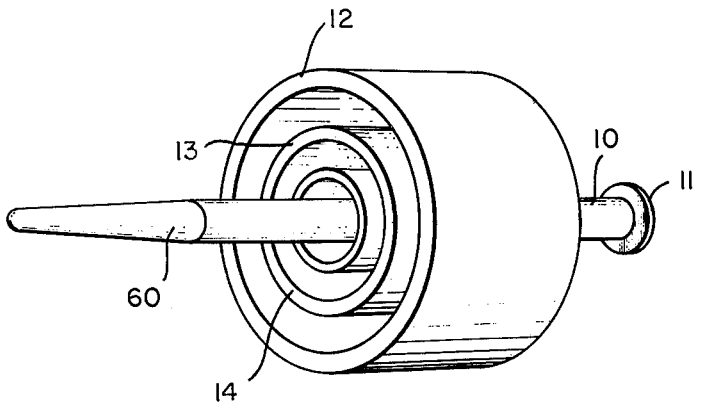
FIG. 10 is a simplified pictorial view illustrating the use of an end-fire element as the central radiating element of the feed.

As mentioned hereinabove, it is sometimes desirable to utilize broadbanding techniques to increase the frequency range of an antenna feed without increasing its diameter. In FIG. 10 there is shown a simplified pictorial view of a portion of the antenna feed of FIG. 2 wherein the central waveguide 10 has been modified by the incorporation of an end-fire element. For the sake of clarity, the various coaxial lines and the dipole end members have been omitted from the figure. In the embodiment of FIG. 10 the end-fire element takes the form of an elongated dielectric member 60 extending axially from waveguide section 10.

The arrangement shown in FIG. 10 is known as a dielectric rod or "polyrod" antenna. Its advantages, characteristics, and design are well known and may be found in most antenna and microwave textbooks (for example, see: G. C. Southworth, *Principles and Applications of Waveguide Transmission,* D. Van Nostrand Co., Princeton, N.J., 1950, pages 433–442). Other examples of end-fire elements include the helix, ferrod and disc-on-rod. With appropriate modification within the scope of the art, the present invention can advantageously utilize such elements.

Figure 11:
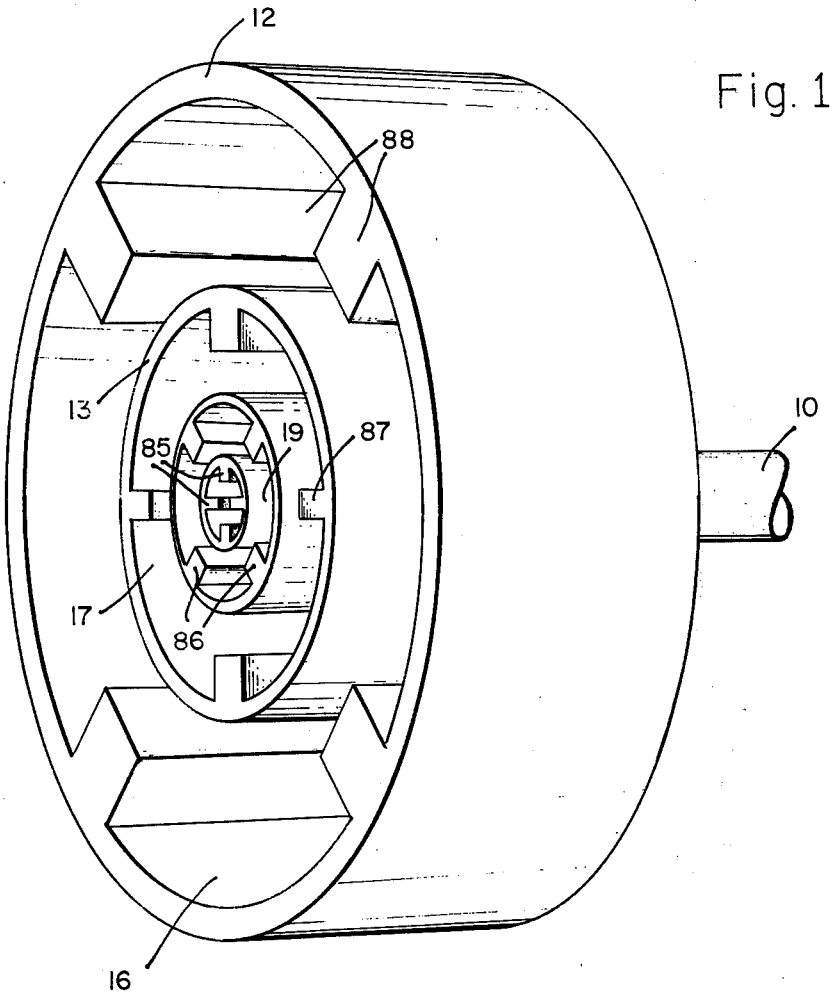
FIG. 11 is a simplified pictorial view of a portion of another embodiment of the present invention.

In FIG. 11, there is shown in simplified pictorial view a portion of another embodiment of the present invention. In FIG. 11 each of the cavities has been provided with conductive ridges which alter their respective resonant frequency ranges. Beginning with the central waveguide section 10, two pairs of opposed conductive ridges 85 extend along its length. Another set of four conductive ridges 86 are spaced around and extend longitudinally along the interior wall of conductive cylinder 14 within cavity 19. Similarly, conductive ridges 87 are disposed within cavity 17 from conductive cylinder 13 and ridges 88 extend within cavity 16 from conductive cylinder 12.

Again, for the sake of clarity, the coaxial feed lines 24a through 26d have been omitted from the drawing. Because of the 45° offset between the dipole wings of the adjacent nested dipole-cavity assemblies, the conductive ridges are also offset. The arrangement of dipole wings shown in FIG. 2 can be employed with the ridge loaded nested cavity structure of FIG. 11. Briefly, the use of ridge loading of the annular cavities provides lower cavity cutoff frequencies and thus wider cavity bandwidths. A wider range of operating frequencies can thereby be achieved for a feed structure of a given overall size.

As mentioned hereinabove, the embodiment of FIG. 2 allows limited monopulse operation by feeding the two dipole wings of a given pair (e.g., wings 23b and 23*d*) out of phase. If dipole wings **23*b* and 23*d* were to be fed out of phase instead of in phase as shown in FIG. 5*a*, then a difference pattern would be obtained in the horizontal (azimuth) plane. The electric field vector would also be in the horizontal plane. Similarly, if dipole wings 23*a* and 23*c* were to be fed out of phase instead of in phase as is shown in FIG. 6*a*, a difference pattern would be obtained in the vertical (elevation) plane which would also correspond to the plane of polarization of the electric field for that dipole-cavity pair. Thus, it is apparent that the monopulse behavior of the feed arrangement of FIG. 2** is limited in that it is restricted to the so-called E-plane of the particular dipole being used.

Figure 12:
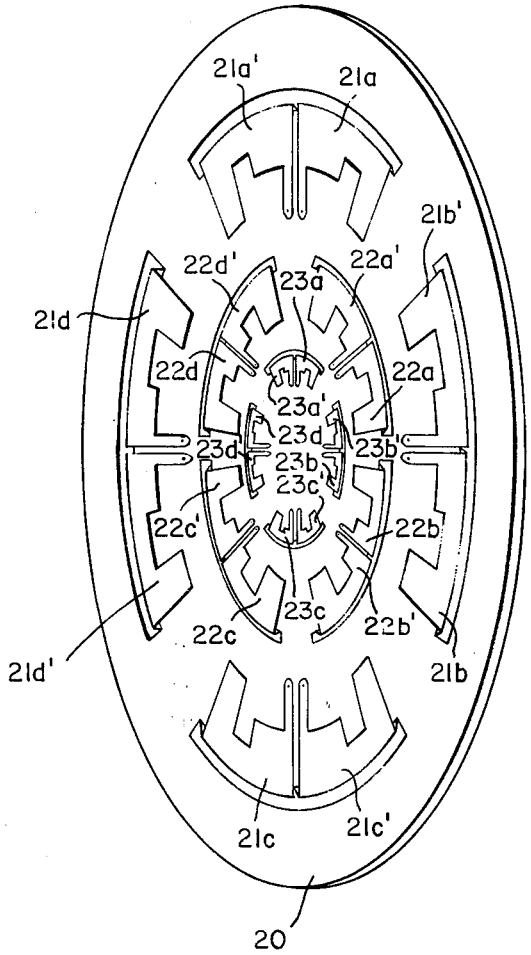
FIG. 12 is a pictorial view of a portion of another embodiment of the present invention illustrating the use of split dipole wings.

In FIG. 12 there is shown in pictorial view a modified arrangement of dipole wings which will allow full dual plane monopulse operation. The numbering of the elements of FIG. 12 has been carried over from FIG. 2 where appropriate. In FIG. 12, each of the dipole wings has been "split" along a radially extending plane to produce a pair of split dipole wings having mirror image symmetry. Thus, the dipole wing identified as **21*a* in FIG. 2 has been modified in the embodiment of FIG. 12 to become split dipole wings 21*a* and 21*a*'. The other dipole wings 21*b* through 21*d*; 22*a* through 22*d*; and 23*a* through 23*d*** also have been modified to split wing geometry. An airgap or a suitable dielectric spacer is used to keep the two split halves of the dipole wings electrically insulated.

In practice, the dipole wings of FIG. 12 together with disc 20 are mounted on the cavity-feed horn assembly in the manner previously described. The cavity-feed horn arrangement of FIG. 2, FIG. 10 or FIG. 11 can be utilized as desired. It is noted that because of the split configuration, each of the dipole wings requires two coaxial or other feed lines instead of the single lines **24*a* through 26*d* shown in FIG. 2. The manner of feeding the embodiment of FIG. 12 and its monopulse operation is illustrated in FIGS. 13 and 14**.

Figure 13:
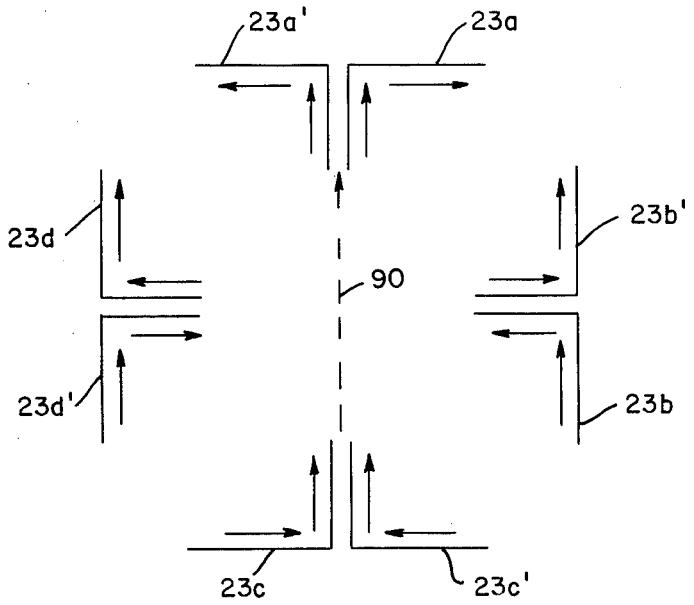
FIG. 13 is a schematic illustration of the current flow in the split dipole wings of FIG. 12.
Figure 14:
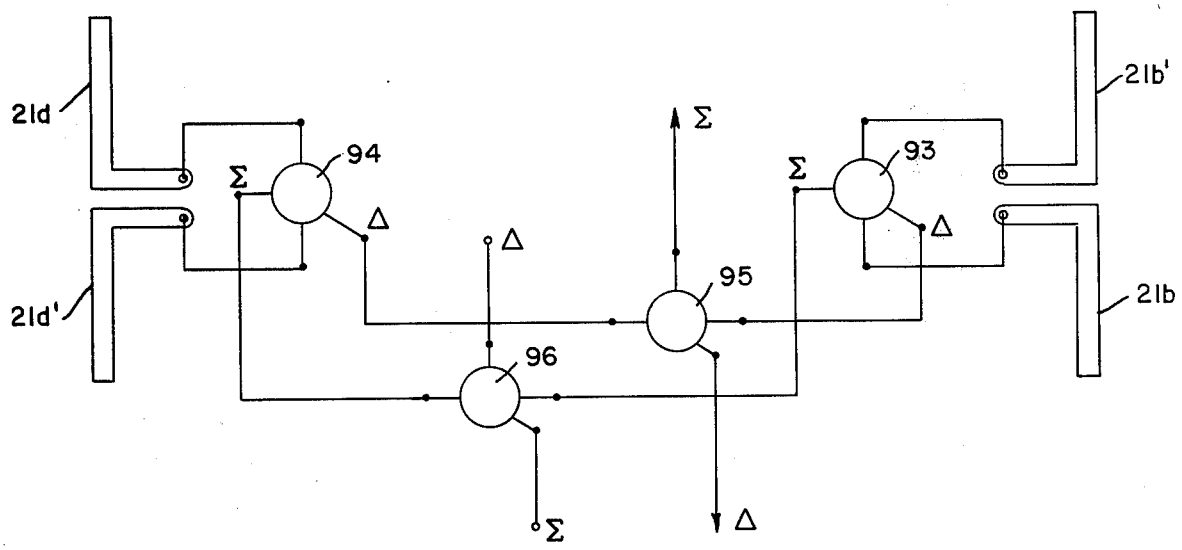
FIG. 14 is a simplified schematic illustration of a portion of the embodiment of FIG. 12 illustrating monopulse operation.

FIG. 13 is a schematic illustration of dipole wings **23*a*, 23*a*', 23*b*, 23*b*', 23*c*, 23*c*', 23*d*, and 23*d*'. In the split configuration of this embodiment, each of the dipole wings is characterized by a pair of parallel segments and a pair of generally linear segments extending oppositely at substantially right angles thereto. Dipole wings 23*a*, 23*a*' and 23*c*, 23*c*' are fed in the manner previously shown in FIG. 6*a*. As indicated by the arrows, the current in both of the split pairs of dipole wings is vertical, as is the effective current 90 flowing around the rim of waveguide section 10. With this mode of feed, the currents in the horizontal portions of the dipole wings 23*a*, 23*a*', 23*c*, and 23*c*'** flow in opposite directions thereby producing substantially no net horizontal current component. The resultant polarization of the electric vector is therefore vertical.

Dipole wings **23*b* and 23*b*' are fed out of phase as are dipole wings 23*d* and 23*d*'. The currents in the parallel portions of these dipole wings, which are horizontal in this example, flow in opposite directions and therefore cancel. The currents flowing around the rim of waveguide section 10** also cancel to produce no net horizontal current component. The currents in the vertical portions of the dipole wings, however, are in the same direction and therefore add to produce two separate vertical polarized radiation sources.

It is precisely the two separated vertically polarized radiation sources which are needed to furnish the desired difference pattern for monopulse operation in the horizontal (azimuth) plane. The sum pattern for the azimuth plane in the vertical polarization is provided by dipole elements **23*a*, 23*a*', 23*c*, and 23*c*'** fed as shown.

Similarly, by feeding dipole wings **23*b*, 23*b*', 23*d*, and 23*d*' in phase as shown in FIG. 5*a*, a horizontally polarized source is created. By feeding dipole wings 23*a*, 23*a*', 23*c* and 23*c*'** differentially, a pair of separated horizontally polarized sources are provided. Thus, monopulse operation in the vertical (elevation) plane can be obtained with horizontal polarization. It is thus seen that depending upon the manner in which the split dipole wings are phased, monopulse operation is possible in either plane, in either polarization.

In practice, it may be advantageous to utilize a wider spacing between the two separated radiators which provide the difference signal. The feed arrangement of the present invention, particularly the broadband embodiments of FIGS. 11 and 12, can provide this flexibility. Referring back to FIG. 12, the inner set of dipole wings **23*a*, 23*a*', 23*c* and 23*c*' can provide the sum pattern, and outer elements 21*b*, 21*b*', 21*d*, and 21*d*' which have a wider separation can provide the difference pattern. In this connection, FIG. 14 is included to show one arrangement for feeding the split dipoles 21*b*, 21*b*', 21*d*, and 21*d*'** for monopulse operation.

FIG. 14 is a simplified schematic illustration of a portion of the embodiment of FIG. 12 showing an arrangement for feeding a typical set of split dipole wings for monopulse operation. In FIG. 14, split dipole wings **21*b*, 21*b*', 21*d*, and 21*d*' are taken as an example. Split dipole wings 21*b* and 21*b*' are connected to the so-called "side arms" of a first 180° hybrid network 93. Dipole wings 21*d* and 21*d*' are connected to the side arms of a second 180° hybrid network 94. The connecting means can conveniently comprise coaxial transmission lines feeding through the nested cavity structure as illustrated in FIG. 2**.

The difference (Δ) ports of hybrid networks 93 and 94 are in turn connected to the side arms of hybrid network 95 whereas the sum (Σ) ports of the first two hybrid networks are connected to the side arms of a fourth 180° hybrid network 96. A difference and the sum output signal components for the dipole wings of FIG. 14 are obtained from the difference (Δ) and sum (Σ) ports of hybrid network 95, respectively. The output signal for the horizontal polarization is derived from the sum port of hybrid network 96 for in-phase operation as shown in FIG. **5*a*. The difference port of hybrid network 96**, on the other hand, provides the anti-phase feedpoint for horizontal polarization.

In all cases it is understood that the above-described embodiments are merely illustrative of but a small number of the many possible specific embodiments which can represent applications of the principles of the present invention. Numerous and varied other arrangements can be readily devised in accordance with these principles by those skilled in the art without departing from the spirit and scope of the invention.

What is claimed is:

1. An antenna feed system comprising, in combination:

a plurality of coaxially disposed conductive cylinders of progressively larger diameters, each having first and second end regions, the first end regions of said cylinders being in substantial transverse alignment;

a plurality of annular conductive members, one of said conductive members being conductively joined between adjacent cylinders across the second end regions thereof;

at least one pair of thin conductive wings extending outwardly in a generally radial direction from opposite sides of each inner cylinder toward the next adjacent outer cylinder, said conductive members being insulated from said cylinders and being substantially parallel to the plane formed by said first end regions; and means for coupling rf energy between each of said conductive wings and a point on the first end region of the cylinder next adjacent said wing.

2. The antenna feed system according to claim 1 wherein the conductive cylinder of the smallest diameter comprises a section of circular waveguide.

3. The antenna feed system according to claim 1 wherein two pair of thin conductive wings extend from each inner cylinder and wherein each of said pairs is orthogonal to the other.

4. The antenna feed system according to claim 1 wherein each of said rf coupling means comprises a coaxial transmission line having an inner conductor coupled to the conductive wing associated therewith and an outer conductor coupled to said cylinder next adjacent said wing.

5. The antenna feed system according to claim 3 wherein each of said conductive wings is split into two portions along a substantially radially extending plane and wherein each of said split portions is conductively insulated from the other.

6. A wideband antenna feed comprising, in combination:

a plurality of cylindrical conductive members of progressively larger diameter coaxially disposed about a common axis, said conductive members being closed at one end thereof to define a plurality of nested annular cavities with common walls therebetween the open ends of said cavities being in substantial transverse alignment;

at least one dipole element disposed adjacent the open ends of each of said cavities and electromagnetically coupled thereto, each of said dipole elements comprising at least three portions including a first dipole wing, a second dipole wing, and a portion of one of said cylindrical conductive members; and means for coupling electromagnetic wave energy between each of said dipole wings and a point on the open end of the cylinder next adjacent thereto.

7. The antenna feed according to claim 6 wherein at least one of said nested annular cavities has disposed therein a plurality of conductive ridges extending longitudinally from one of the cylindrical conductive members defining said cavity.

8. A wideband antenna feed comprising, in combination:

a plurality of cylindrical conductive members of progressively larger diameters coaxially disposed about a common axis, said conductive members being closed at one end thereof to define a plurality of nested annular cavities with common walls therebetween, the open ends of said cavities being in substantial transverse alignment.

at least one dipole element disposed adjacent the open ends of each of said cavities and electromagnetically coupled thereto, each of said dipole elements comprising at least five portions including a first bifurcated dipole wing, a second bifurcated dipole wing, and a portion of one of said cylindrical conductive members, said dipole wing bifurcations being along substantially radially-extending directions; and means for coupling electromagnetic wave energy to each of said dipole elements.

9. The antenna feed according to claim 8 wherein at least one of said annular cavities has disposed therein conductive means adapted to increase the resonent bandwidth of that cavity.

10. The antenna feed according to claim 9 wherein said conductive means comprises a plurality of longitudinally extending conductive ridges disposed about and conductively joined to one of the conductive members defining said cavity.

11. A wideband antenna feed comprising, in combination:

a plurality of cylindrical conductive members of progressively larger diameters coaxially disposed about a common axis, said conductive members being closed at one end thereof to define a plurality of nested annular cavities with common walls therebetween;

at least one dipole element disposed adjacent the open ends of each of said cavities and electromagnetically coupled thereto, each of said dipole elements comprising a pair of split end members and a portion of one of said cylindrical conductive members;

first and second 180 degree hybrid networks;

means for coupling the side arms of said first hybrid network to the two split end members of one of said dipole elements;

means for coupling the side arms of said second hybrid network to the two split end members of the other of said dipole elements;

means for coupling the difference arms of said first and second hybrid networks together to form a first pair of feed ports of said antenna feed; and means for coupling the sum arms of said first and second hybrid networks together to form a second pair of feed ports of said antenna feed.

* * * * *